US005996797A

United States Patent [19]

Flaig

[11] Patent Number: 5,996,797

[45] Date of Patent: Dec. 7, 1999

[54] TOWELETTE POUCHES WITH OUTER CONTAINER OR SADDLE

[75] Inventor: Raymond Michael Flaig, Stamford, Conn.

[73] Assignee: Chesebrough-Pond's USA Co. Division of Conopco, Inc., Greenwich, Conn.

[21] Appl. No.: 09/201,457

[22] Filed: Nov. 30, 1998

Related U.S. Application Data

[60] Provisional application No. 60/098,462, Aug. 31, 1998.

[51] Int. Cl.[6] ..... B65D 81/24; B65D 5/54; B65D 30/16; B65H 1/04

[52] U.S. Cl. ..... 206/494; 206/210; 206/812; 221/48; 221/64; 229/230; 229/232; 383/66; 383/211; 383/104

[58] Field of Search ..... 206/494, 210, 206/812; 383/66, 211, 119, 104; 221/48, 63–65; 229/230, 232, 207

[56] References Cited

U.S. PATENT DOCUMENTS

| | | | |
|---|---|---|---|
| 1,910,094 | 5/1933 | Crane et al. . | |
| 2,014,335 | 9/1935 | Kilmer et al. | 229/232 X |
| 2,316,796 | 4/1943 | Lichter . | |
| 2,619,226 | 11/1952 | Adams . | |
| 2,973,086 | 2/1961 | Thompson | 229/232 X |
| 3,243,078 | 3/1966 | Pherson . | |
| 3,254,793 | 6/1966 | Palmer . | |
| 3,346,141 | 10/1967 | Pherson et al. . | |
| 3,349,959 | 10/1967 | Watkins . | |
| 3,580,466 | 5/1971 | Thelen et al. | 229/232 X |
| 3,784,055 | 1/1974 | Anderson . | |
| 3,986,479 | 10/1976 | Bonk . | |
| 4,043,503 | 8/1977 | Meyers et al. | 229/232 X |
| 4,156,493 | 5/1979 | Julius . | |
| 4,210,247 | 7/1980 | Frye et al. | 206/494 |
| 4,420,080 | 12/1983 | Nakamura . | |
| 4,538,396 | 9/1985 | Nakamura . | |
| 4,552,269 | 11/1985 | Chang . | |
| 4,610,357 | 9/1986 | Nakamura . | |
| 4,616,470 | 10/1986 | Nakamura . | |
| 4,651,874 | 3/1987 | Nakamura . | |
| 4,653,250 | 3/1987 | Nakamura . | |
| 4,790,436 | 12/1988 | Nakamura . | |
| 4,817,790 | 4/1989 | Poret et al. | 206/817 X |

(List continued on next page.)

FOREIGN PATENT DOCUMENTS

| | | | |
|---|---|---|---|
| 1322263 | 7/1973 | United Kingdom | 229/232 |

*Primary Examiner*—Bryon P. Gehman
*Attorney, Agent, or Firm*—Milton L. Honig

[57] ABSTRACT

A towelette product is provided usable for cleansing/make-up removal which includes a stack of folded flexible towelettes impregnated with a fluid composition, a pouch for storing the stack of towelettes and an outer container surrounding the pouch and having walls more rigid than the flexible sheet forming the pouch. A dispensing aperture is formed in a deck panel of the pouch. A seal is adhesively arranged over the dispensing aperture to minimize fluid evaporation and control foreign objects from contaminating the towelettes. The outer container is defined by top, bottom, front, rear and side walls, the top wall having an opening with left and right flanking panels, the opening of the container and dispensing aperture of the pouch being aligned to allow towelette removal. A lid is hingedly attached to the outer container which in a closed position overlies the opening and at least a portion of the flanking panels. In a second embodiment of the seal for the pouch, a support saddle is provided to overlay and adhere to the deck panel and both side panels. A cut-out portion is hingedly attached near a rear portion of the support saddle. The cut-out portion is adhesively reclosable and aligned over the dispensing aperture. The support saddle provides rigidity to the respective panels of the pouch against which it adheres. Collapse in the face of a decreasing stack of form-retaining towelettes is prevented by the support saddle structure.

6 Claims, 3 Drawing Sheets

U.S. PATENT DOCUMENTS

| | | | |
|---|---|---|---|
| 4,840,270 | 6/1989 | Caputo et al. . | |
| 4,863,064 | 9/1989 | Dailey, III | 221/48 |
| 4,997,105 | 3/1991 | Fischer . | |
| 5,145,091 | 9/1992 | Meyers . | |
| 5,158,205 | 10/1992 | Bodziak et al. . | |
| 5,242,057 | 9/1993 | Cook et al. . | |
| 5,361,936 | 11/1994 | Cook | 221/63 |
| 5,379,897 | 1/1995 | Muckenfuhs et al. | 206/494 |
| 5,462,197 | 10/1995 | Pound . | |
| 5,520,308 | 5/1996 | Berg, Jr. et al. . | |
| 5,531,325 | 7/1996 | Deflander et al. . | |
| 5,577,612 | 11/1996 | Chesson et al. | 206/494 |
| 5,647,506 | 7/1997 | Julius . | |
| 5,688,394 | 11/1997 | McBride, Jr. et al. . | |
| 5,791,465 | 8/1998 | Niki et al. | 206/494 X |

2/3

TOWELETTE POUCHES WITH OUTER CONTAINER OR SADDLE

This application derives priority under 35 U.S.C. §119(e) to Provisional Patent Application Serial No. 60/098,462 filed Aug. 31, 1998.

BACKGROUND OF THE INVENTION

1. Field of the Invention

The invention concerns a towelette product and a package for dispensing towelettes.

2. The Related Art

Fluid impregnated pads, sheets and tissues (collectively defined as towelettes) are established articles of commerce. They are generally utilized for personal hygiene, cosmetic purposes and household cleaning applications. Volatility of the fluid requires packaging which avoids evaporation. Problems arise where a stack of towelettes are packed together in a common container. Dispensing of a single item requires resealability of the container to prevent the remaining articles from drying out. Notable advances in the art include the following disclosures.

U.S. Pat. No. 4,156,493 (Julius) describes a reclosable dispenser packet with moisture impregnated towelettes stored within a semi-rigid or flexible walled container. One of the embodiments includes a dispensing opening covered by a hinged flap with a pressure sensitive adhesive border on an undersurface for resealability over the opening.

U.S. Pat. No. 4,790,436 (Nakamura) discloses a resealable dispenser-container for wet tissues. A deformable pouch containing a stack of the tissues is held rigid with the assistance of a shape maintaining member even after most of the tissues have been dispensed. Suitable shape maintaining members include an outer box surrounding the pouch fixed with an adhesive on an undersurface of the box roof which prevents pouch wall collapse. A second embodiment is a U-shaped frame inserted within the pouch. Both of these solutions present either cost or manufacturing difficulties.

U.S. Pat. No. 5,531,325 (Deflander et al.) describes a pouch for storing interleaved tissues with a resealable flap opening. The pouch is housed in a rigid outer container which in its closed position is sufficiently air-tight to prevent exchange of air between contents of the container and the outside atmosphere. An anti-slip member such as a glue strip is attached to the pouch and projects through a hole in the bottom of the container to prevent the latter from slipping on a support surface. The air-tight outer container requires considerable plastic material in its construction. Not only is the container heavy but the relatively large amount of plastic presents an environmental disposal issue.

Evident from the foregoing selection of technology is the need for improved, more commercially oriented solutions to the pouch deflation problem.

Accordingly, it is an object of the present invention to provide a towelette product which can dispense towelettes one at a time and be resealable.

It is a further object of the present invention to provide a towelette product which after having dispensed most of a stack of towelettes is substantially as efficiently resealable as in its initial fully towelette filled position.

Another object of the present invention is to provide a towelette product and a related method capable of efficiently cleansing and removing make-up from facial and other skin areas.

These and other objects of the present invention will be more readily evident from the following summary and detailed discussion.

SUMMARY OF THE INVENTION

A towelette product is provided which includes:

a stack of folded flexible towelettes impregnated with a fluid composition;

a pouch formed of at least one flexible sheet to contain the stack of folded towelettes and containing a dispensing aperture through which towelettes are removable and a flexible seal with adhesive borders and having a size sufficient to resealably cover the aperture securing same to prevent evaporation of fluid;

an outer container formed of top, bottom, front, rear and side walls more rigid than the at least one flexible sheet of the pouch, the top wall having an opening with left and right flanking panels, the opening and aperture being aligned to allow towelette removal, a lid including a lid plate and a lid extension, the lid being hingedly attached to the container which in a closed position overlies the opening and at least a portion of the flanking panels, the lid extension being bent orthogonal to the lid plate and including a tab insertable into a slit within a front wall of the container.

Further features of the outer container include a cut-out portion on the front wall contiguous with the opening and formed above the slit. The cut-out portion allows easier access to the dispensing aperture and enables better manipulation of the flap. When the lid is in a closed position, the lid extension is arranged juxtaposed over the cut-out portion.

Advantageously towelettes of the present invention are folded in a Z-shaped formation, preferably not interleaved. The Z fold consists of a center panel flanked by upper and lower wing panels. The upper and lower wing panels are substantially of equal width and substantially half of a width of the center panel. Each towelette is folded medially in a direction orthogonal to that of the Z-shaped formation. Advantageously the size of the towelette may range in length from 10 to 40 cm, preferably from 15 to 30 cm, optimally from 18 to 24 cm. The width of the towelette may range from 8 to 30 cm, preferably from 10 to 25 cm, optimally from 15 to 20 cm.

Any kind of material may be employed as a towelette, although certain materials are preferable. Suitable substances include woven and non-woven synthetic or natural fibers. Typical fibers include cellulose, rayon, polyethylene, polypropylene, polyester, cotton, polyamide and combinations thereof. Most preferred are non-woven substrates, especially blends such as rayon/polyester in ratios of 10:90 to 90:10, preferably ratios of 20:80 to 80:20, optimally 40:60 to 60:40. A most useful towelette is a 70:30 rayon/polyester non-woven wipe article.

Containers of the present invention are preferably cellulosic, especially a paperboard carton. Each of the two opposite side walls of the carton are hingedly attached to a top surface near respective left and right flanking panels. When swung into an open position, a window appears framed by a pair of opposing shutters. This window allows for removal or introduction of the pouch into the container carton. A closure underflap formed unitarily with and bent at right angles to the side wall engages underneath the shutters for locking the side walls.

Containers of the present invention normally are not formed of rigid plastic nor have lids intended to be air-tight or that prevent free exchange of air between ambient and the inside of the container.

Cleansing and make-up compositions of the present invention normally may contain a surfactant, particularly a foaming yet mild surfactant, water and a make-up removing agent. Amounts of the surfactant may range from 0.5 to 15%. Particularly preferred is a lauroamphoacetate salt, a sarcosinate salt, a cocoamidopropylbetaine, a dimethylbetaine or an alkylpolyglycoside. Amounts of the make-up removing agent may range from about 0.1 to about 15%. Illustrative agents in this category include polyalkoxy $C_{12}$–$C_{24}$ fatty acids such as PEG-40 hydrogenated castor oil, $C_2$–$C_{10}$ glycols such as hexylene glycol and mixtures thereof. Water may be present at levels ranging from about 5 to about 99%, preferably from about 70 to about 95%. Additionally, the formulation may contain botanical or herbal extracts such as chamomile, green tea, ginseng, cucumber, cornflower and aloe vera as well as mixtures thereof.

In a further aspect of this invention, there is disclosed an improved seal arrangement of dimensions which reinforce the pouch against collapse even when emptied beyond 50%. The seal arrangement is shaped as a support saddle with an upper portion flanked at opposite borders by front and rear portions. The upper portion includes a seal which is formed as a cut-out section, preferably hingedly connected on one of its edges to the remaining upper portion, and being alignable over the dispensing aperture of the pouch. The seal is a flexible member with adhesive undersurface borders functioning as a peel and reseal label. Alternatively the seal may be of a material not originally cut from the upper portion. Front and rear portions are bent at from 60 to 120° angle relative to a plane of the upper portion. Most preferably the angle is about 90°. Undersurfaces of the front and rear portions as well as the top portion must adhere to the pouch at respective outer surfaces of the deck and side panels. Adhesive, sonic welding or a pressure applied hot seal insure strong attachment of the saddle around the pouch.

BRIEF DESCRIPTION OF THE DRAWING

The objects, features and embodiments of this invention will now be described in more detail with reference to the accompanying drawing in which.

DETAILED DESCRIPTION OF THE INVENTION

Figure 1:
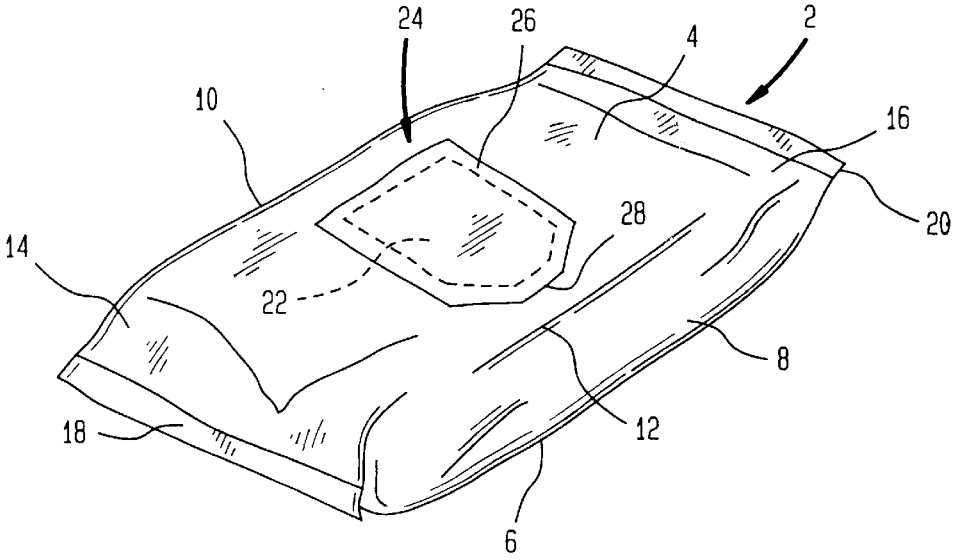
FIG. 1 is a front elevational view of the pouch containing towelettes according to the present invention.

According to the present invention a stack of folded flexible towelettes are packaged within a flexible walled pouch 2. FIG. 1 best illustrates the pouch. It features a deck panel 4, a floor panel 6 and a pair of side panels 8, 10 parallel to one another. The relationship of deck/floor panels to the side panels are substantially orthogonal. Ordinarily there will not be sharp edges 12. This is especially so when the package is empty or emptied of towelettes. In fact, the pouch may originate as an elongate cylinder. Only upon being filled with a rectangular stack of the towelettes does the cylindrical wall take on a rectangular shape with distinct panels. The pouch further includes a pair of end panels 14, 16 which along a median section 18, 20 are sonically, heat, adhesively or otherwise sealed with a crimp pattern being shown. A similar type of crimped seal (not shown) may be found along the floor panel. A dispensing aperture 22 is cut into the deck panel of the pouch. Over this aperture is a seal 24 consisting of a flexible flap with adhesive borders 26. Along a front edge of the dispensing aperture is a seal tab 28 not adhesively attached to the pouch. The seal tab functions as a grip for opening seal 24 to allow dispensing of a towelette.

Figure 2:
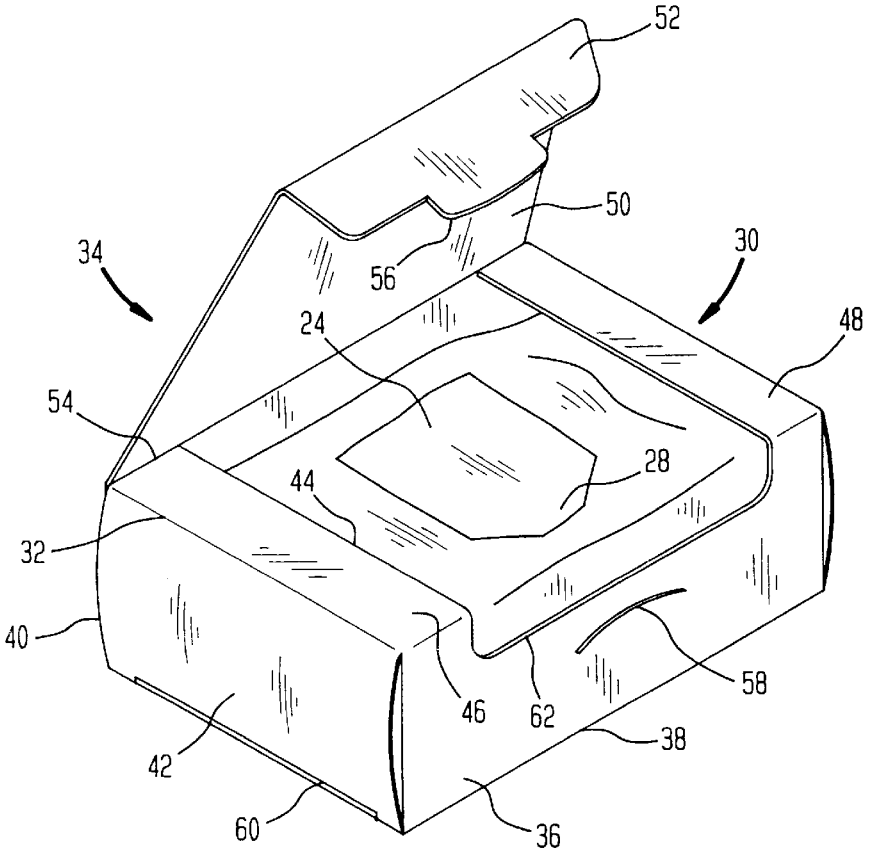
FIG. 2 is a front elevational view of the pouch, shown in FIG. 1, within an outer rigid container with lid in an open position.

FIG. 2 best illustrates outer container 30 within which is placed the pouch. The outer container is preferably a paperstock material more rigid than the flexible sheet material forming the pouch. Among the functions of the outer container is as a corset preventing the panels of the pouch from slouching as the form holding stack of towelettes becomes diminished. Another function for the outer carton is to allow a top wall 32, and most especially a lid 34 to bear advertising (including brand name, designation of pouch contents and pictorial). Along a retail shelf, an elongate front wall 36 of the outer container will rest on the shelf so that the top wall and lid are vertically facing customers.

Outer container 30, shown in the form of a carton, not only includes a top wall 32 and front wall 36 but also a bottom wall 38, a rear wall 40 and a pair of side walls 42. Top wall 32 has an opening 44 defined by left and right flanking panels 46, 48. Opening 44 is aligned with seal 24 and dispensing aperture 22 to allow ready opening of the seal and removal of towelettes through the aperture.

Lid 34 consists of a lid plate 50 and a lid extension 52. The lid is hingedly attached to an edge 54 of the outer container top wall 32. Hinged edge 54 is perforated to provide an option for tearedly removing the lid.

Figure 3:
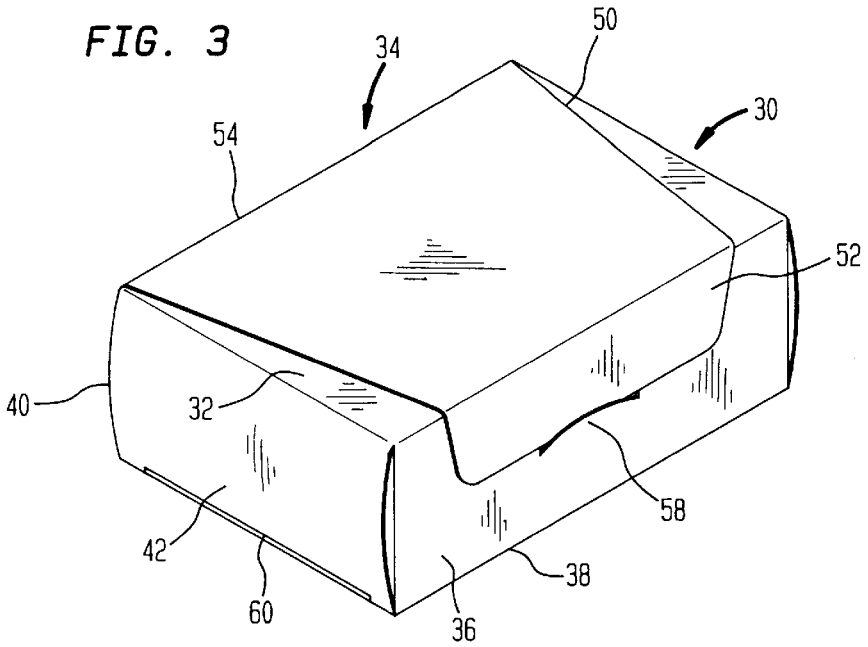
FIG. 3 is a front elevational view of the container and pouch shown in FIG. 2 with lid in a closed position.

FIG. 3 illustrates the lid in a closed position overlying the opening and at least a portion of the panels. Extension 52 is bent orthogonally to the lid plate 50 and includes a tab 56 insertable into a slit 58 formed within front wall 36 of the container. Each of the side walls 42 are hingedly connected to top wall 32. On an end distant from the hinged attachment of side wall 42 is an underflap 60 which is bent parallel to the bottom wall.

The towelette product of the present invention is most conveniently assembled by pre-forming the pouch and inserting same into a pre-assembled outer container by sliding the pouch through the window of an opened side wall. Thereafter the side wall is folded along its hinged border with the top wall followed by folding of the underflap which is inserted perpendicularly through the window toward an interior of the carton.

A cut-out portion 62 is formed on the front wall contiguous with the opening 44. The cut-out portion has a span length approximately equal to a parallel span length defining a rear most border of the opening.

Figure 4:
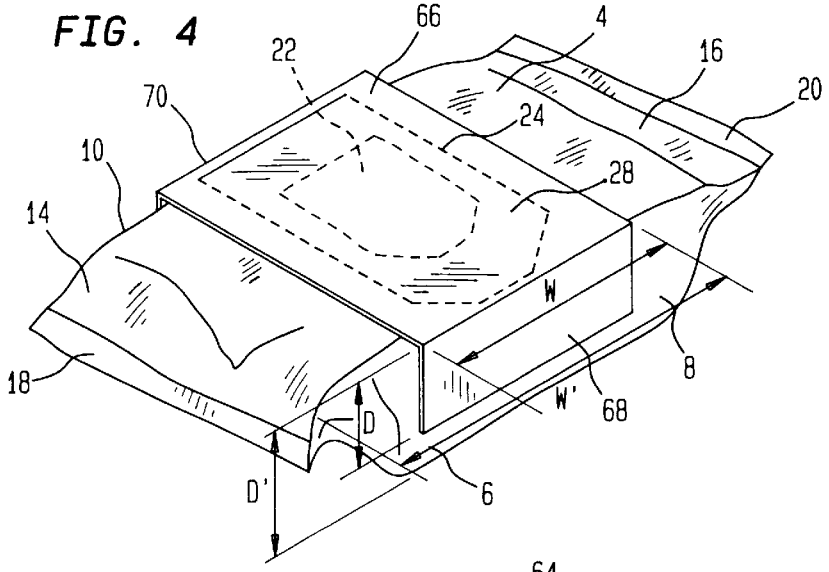
FIG. 4 is a front elevational view of the pouch shown in FIG. 1 with the seal being replaced by a U-shaped support saddle.
Figure 5:
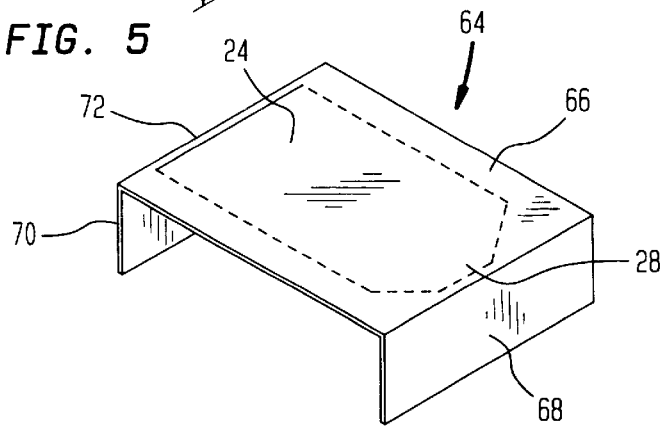
FIG. 5 is a front elevational view of the saddle of FIG. 4 but excluding the pouch.

FIG. 4 best illustrates the pouch with a second, preferred embodiment of seal 24. A support saddle 64 is provided with an upper portion 66 flanked at opposite borders by a front portion 68 and a rear portion 70. Seal 24 is unitarily formed as the support saddle 64.

Figure 6:
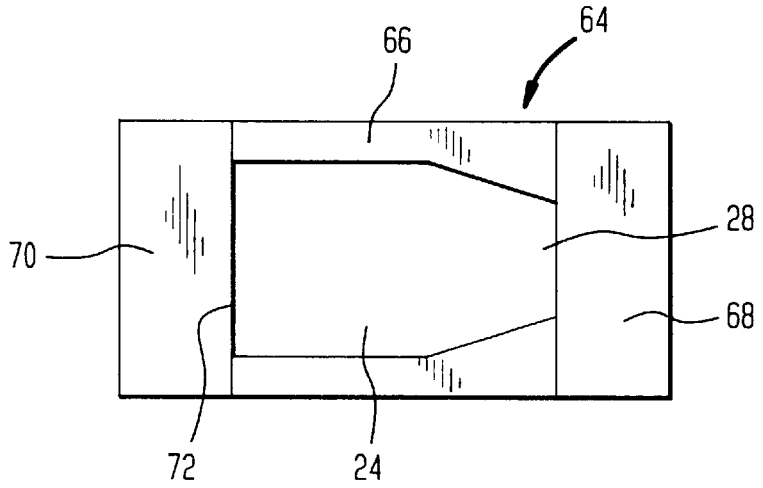
FIG. 6 is a top plan view of FIG. 5 but in a flattened configuration.

FIG. 6 illustrates support saddle 64 prior to front and rear portions being bent into the saddle. Prior to application around the pouch, the support saddle is die-cut to achieve perforations outlining the seal except along a rear border 72 which lies along an upper edge of the rear portion. Rear border 72 functions as a hinge for seal 24.

FIG. 4 illustrates application of the support saddle 64 around pouch 2. Adhesives, sonic welding and/or heat seals marry undersurfaces of the support saddle to the upper surfaces of the deck and side panels. The support saddle must be oriented to arrange seal 24 directly over dispensing aperture 22. Front portion 68 and rear portion 70 of the support saddle extend at least half-way and preferably more than 80% down a depth of respective side panels 8, 10. Width W preferably has a distance approximately 80%, preferably approximately 60% but optimally approximately 30% a width W' that of the deck panel 4.

Figure 7:
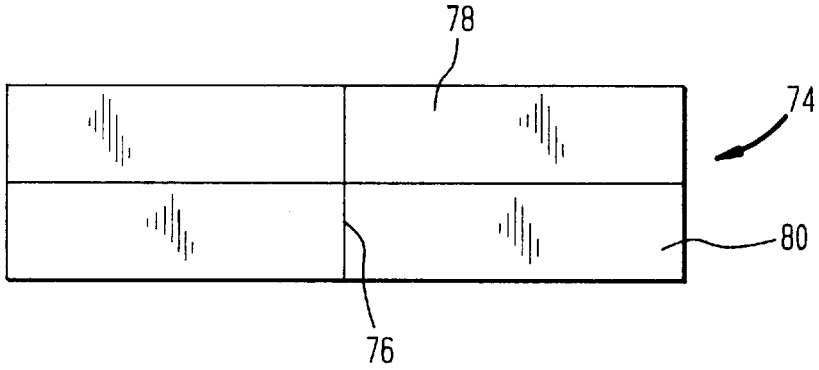
FIG. 7 is a top plan view of a non-folded towelette dispensable from the pouch.
Figure 8:
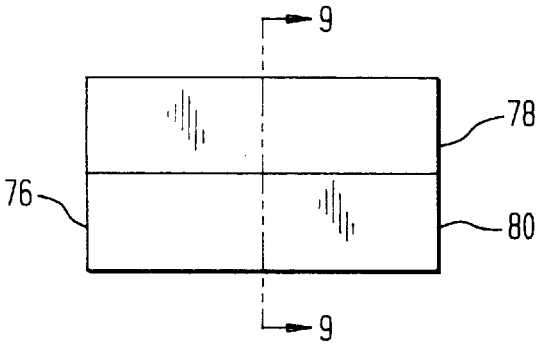
FIG. 8 is a top plan view of the towelette shown in FIG. 7 in folded-over position.

FIG. 7 illustrates a towelette 74 showing a fold line 76, an upper wing panel 78 and a center panel 80 to which the upper wing panel is unitarily attached. Upper wing panel 78 has a width approximately half that of the center panel 80. FIG. 8 illustrates towelette 74 folded over along the fold line 76.

Figure 9:
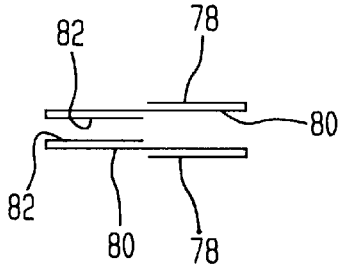
FIG. 9 is a cross-sectional view of the folded towelette as shown in FIG. 8.

FIG. 9 in cross-section illustrates layer-wise from top to bottom the upper wing panel 78, the center panel 80, a lower wing panel 82, and then another section of each of the lower wing panel 82, the center panel 80 and the upper wing panel 78.

The foregoing description illustrates selected embodiments of the present invention. In light thereof, various modifications would be suggested to one skilled in the art, all of which are within the spirit and purview of this invention.

What is claimed is:

1. A towelette product comprising:

a stack of folded flexible towelettes impregnated with a fluid composition;

a pouch formed of at least one flexible sheet to contain the stack of folded towelettes and containing a dispensing aperture through which towelettes are removable and a flexible seal with adhesive borders and having a size sufficient to resealably cover the aperture securing the aperture to prevent evaporation of fluid;

an outer container formed of a top wall, a bottom wall, a substantially planar front wall, a rear wall and side walls more rigid than the at least one flexible sheet of the pouch, the top wall having an opening with left and right flanking panels, the opening and aperture being aligned to allow towelette removal, a lid including a lid plate and a lid extension, the lid being hingedly attached to the container which lid in a closed position overlies the opening and at least a portion of the flanking panels, the lid extension being bent orthogonal to the lid plate and overlies the planar front wall, the lid extension including a tab insertable into a slit within the planar front wall of the container.

2. The product according to claim 1 wherein each of the towelettes are folded in a Z-shaped formation having a center panel and upper and lower wing panels, the wing panels each being of about equal width and about half of a width of the center panel.

3. The product according to claim 2 wherein each of the towelettes are folded medially in a direction orthogonal to that of the Z-shaped formation.

4. A package for storing and dispensing towelettes comprising:

a pouch formed of at least one flexible sheet to contain a stack of folded towelettes, the pouch being defined by a deck panel, a floor panel opposite the deck panel and a pair of opposing side panels, the deck panel including a dispensing aperture through which towelettes are removable; and a support saddle defined by an upper portion, a front portion and a rear portion, the upper portion separating the front and rear portions, the upper portion including a seal cut from the upper portion except along a rear border which is hingedly attached near an upper edge of the rear portion and adhesively sealed in a closed position against the upper portion of the pouch, the front and rear portions extending downward along an outer surface of each of the front and rear portions adhesively attached thereto thereby supporting the pouch against collapse as the stack of towelettes within the pouch diminishes.

5. The package according to claim 4 wherein the support saddle is formed of a material different than materials forming the panels of the pouch.

6. The package according to claim 5 wherein the materials of the support saddle are more rigid than the materials forming panels of the pouch.

* * * * *